United States Patent [19]

Lipets

[11] 4,396,002

[45] Aug. 2, 1983

[54] TUBULAR AIR HEATER

[76] Inventor: Adolf U. Lipets, prospekt Lenina, 150a, kv. 38, Podolsk, U.S.S.R.

[21] Appl. No.: 335,192

[22] Filed: Dec. 28, 1981

Related U.S. Application Data

[63] Continuation-in-part of Ser. No. 295,752, Aug. 24, 1981, abandoned, and a continuation-in-part of Ser. No. 42,877, May 29, 1979, abandoned.

[51] Int. Cl.[3] ..... F24H 3/02; F24B 7/02

[52] U.S. Cl. ..... 126/110 R; 126/99 A; 126/109; 122/1 A; 165/143; 165/144; 237/55

[58] Field of Search ..... 122/1 A, DIG. 1, DIG. 2; 126/99 A, 110 R, 109; 110/254; 237/50, 55; 165/143, 144

[56] References Cited

U.S. PATENT DOCUMENTS

| | | | |
|---|---|---|---|
| 1,769,994 | 7/1930 | Hendryx | 126/109 |
| 2,418,815 | 4/1947 | Baver | 122/1 A |
| 2,707,458 | 5/1955 | Hayden | 122/1 A |
| 2,744,733 | 5/1956 | Howes | 122/1 A |
| 2,803,439 | 8/1957 | Fikenscher | 122/1 A |
| 3,180,406 | 4/1965 | Oechslin | 126/109 |
| 4,033,320 | 7/1977 | Jury | 126/110 R |
| 4,034,482 | 7/1977 | Briscoe | 165/DIG. 2 |
| 4,044,950 | 8/1977 | Engeling et al. | 126/116 A |

*Primary Examiner*—Henry C. Yuen
*Attorney, Agent, or Firm*—Lilling & Greenspan

[57] ABSTRACT

An air heater comprises a plurality of passes, each having tube banks built into a gas conduit through which passes a flow of heating gas. It also comprises a plurality of delivery and collecting air ducts series-arranged one above the other. The delivery air ducts adjoin the tube banks of each pass and communicate therewith through outlets. The collecting air ducts adjoin the tube banks of each pass and communicate therewith by means of inlets. The collecting air duct is connected to the delivery air duct, the next-in-order along the flow of air, by means of interconnecting air conduits, which are positioned in the interspaces between the tube banks of each individual pass. Each interconnecting air conduit has an inlet orifice adapted to admit a flow of air passing from the collecting air duct, and an outlet orifice through which a flow of air passes from the interconnecting air conduit into the delivery duct. The first, as viewed in the direction of air flow, delivery duct has an inlet intended for communication with a source of air to be heated, while the last, as viewed in the direction of air flow, collecting duct has an outlet intended for communication with a container for the heated air.

2 Claims, 4 Drawing Figures

TUBULAR AIR HEATER

REFERENCES TO RELATED APPLICATIONS

The present application is a continuation-in-part of patent application Ser. No. 295,752, filed on Aug. 24, 1981, for the TUBULAR AIR HEATER, which is a continuation of patent application Ser. Nos. 42,877 and 295,752 "Tubular Air Heater", filed with U.S. Patent Office on May 29, 1979 and Aug. 24, 1981, respectively, and now abandoned.

DESCRIPTION OF PRIOR ART

There is known an air heater described in U.S. Pat. No. 2,744,733. It consists of two sections, the larger of which is connected to a main gas duct, and the smaller to a gas bypass conduit, with the flow rate of gas passing therethrough being controlled by means of dampers. With regard to hotair flow, these sections are connected in series, first the smaller and then the larger. The smaller section consists of three tube banks positioned vertically in an air conduit. These three tube banks are interconnected by means of gas conduits and are arranged for the parallel flow of gas and air. An inflow of cold air is initially heated by hot gases fed into the tubes and, while passing through the air duct from one tube bank to another, continues to be heated in three passes by the gases undergoing cooling. The larger section is made up of a single bank of vertical tubes divided along the length by two partitions forming, together with adjoining air ducts, a three-pass counterflow circuit. With the parallel flow of fluids in the smaller section and the counterflow in the larger section, each of them forms a three-pass cross-flow heat exchanger. This type of air heater has the advantages of good corrosion resistance, which is ensured by the parallel flow of fluids in the smaller section and wherein the hottest gases heat up the cold air, and of a minimum consumption of metal for the manufacture of the air heater, which is made possible by the counterflow circuit system in the larger section.

However, the above-described air heater suffers from serious disadvantages. The first to mention is its complex structural arrangement; there are provided two gas ducts placed in parallel, and auxiliary interconnecting gas conduits, as well as air conduits. The air heater in question is also difficult to operate. For example, it is necessary to control the flow rate of gases between the main and bypass gas ducts. In addition, the air heater is bulky in construction due to its large working dimensions.

With regard to the economy of metal for the heating surfaces, it should be observed that even the larger counterflow section of the apparatus is provided with only three passes which fail to ensure full utilization of the counterflow temperature gradient.

However, all the structural complications of the above-described air heater which, in all probability, are necessary to ensure its corrosion resistance, turn out to be superflous when the air heater is used in boilers operable on a sulfur-free dry fuel. In this case, the provision of the parallel flow section also brings about an excessive consumption of metal.

Further, the prior-art air heater is unsuitable for burning high-ash fuel, since numeraous bends in the passage of the gas flow will invariably increase the rate of abrasive wear of both the gas ducts and tubes of the air heater.

As a whole, the air heater according to U.S. Pat. No. 2,744,733 is ineffective and unsuitable for use in heavy-duty boilers adapted for burning dry and, in particular, high-ash fuel.

To the best of our knowledge, the air heaters of this type are not used in heavy-duty boilers either in the U.S.A. or elsewhere.

There is known an air heater described in U.S. Pat. No. 4,044,950. It is basically an air boiler in which most of the heat recovered from the fuel combustion is utilized for air heating purposes, with an auxiliary air heater using the outgoing gases of the air boiler. The auxiliary air heater is connected to the bypass cold air duct. The sections of the air heater are series-connected by means of a gas duct and are connected in parallel to a cold air return duct through air conduits. The heated air is passed from the auxiliary air heater to a hot air duct.

The auxiliary air heater is made in the form of a helical concurrent heat exchanger for use in heating systems. The direct-flow circuit system of the auxiliary heat exchanger makes it impossible for the air to be heated to high temperatures or for the outgoing gases to be cooled down to very low temperatures. The construction of the auxiliary heat exchanger with a helical flow of air is not disclosed, since similar heat exchangers are known in the art. The helical motion of air in these heat exchangers is provided to increase velocity and has virtually no effect on the heat-transfer system at all. The direct-flow circuit is ineffective, which explains the low operating efficiency of the given heat exchanger as well as its inadequacy for employment in heavy-duty boilers.

U.S. Pat. No. 4,034,482 discloses an air heater which comprises platens forming flat alternating channels through which pass heat-transfer fluids; a heating medium and a flow of air being heated pass in adjacent channels. The walls of these channels serve as the heating surfaces. A flow of air passes along three parallel channels, and the heat-transferring gases pass along four series-connected channels. The motion of fluids is mutually perpendicular. The air heater is provided with an air by-pass. In appearance, the air heater described above looks as if it were a multipass apparatus. However, it turns out to be just a single-pass cross-flow heat exchanger, as is seen from its schematic representation.

It is common knowledge that the temperature gradient is the least efficient in use with the single-pass cross-flow circuit. Also, this type of circuit makes it impossible to ensure a high-temperature heating of air or deep cooling of the outgoing gases. The recuperative air heaters with flat channels are known to be unsuitable for use in heavy-duty boilers. Therefore, the above-described air heater is inefficient and inadmissable for use in heavy-duty boilers.

There is known still another standard american air heater which is used by the BeW firm for installation in heavy-duty power units. It is a tubular two-pass air heater, very compact, having a single interconnecting gas and practically no interconnecting air conduits.

Though the above-described air heater is extremely simple in construction, it has serious disadvantages, the main of which is an excessively large heating surface area, which can be attributed to the provision of ineffective two-pass cross-flow circuit and to the absence of conditions for intermixing of fluids between the passes.

In other words, this type of heat-transfer circuit is not conducive to effective utilization of the available temperature gradient. Another disadvantage of the BeW air heater is the provision of an interconnecting gas, as a result of which the ash concentration field is upset to cause an increase in the rate of abrasive wear. The air heater in question is unsuitable for use where high-ash solid fuels are employed.

BACKGROUND OF THE INVENTION

The present invention relates to heat exchange engineering and boiler making and, more specifically, to tubular air heaters for steam boilers, furnaces and similar installations.

In conventional tubular air heaters incorporated in high-power boilers use is made of the air and gas cross-flow circuit making it impossible to ensure effective utilisation of the available temperature gradient with a small number of passes. As a result, these types of air heaters require much metal for their fabrication and are bulky in shape.

There is known a method of increasing the temperature gradient in cross-flow air heaters by using a Z-cross-flow circuit, according to which a flow of air moving in a multipass tubular air heater from one pass to another enters into tube banks of each pass from one and the same side relative to the direction of gas flow. As a result, the simplest in construction two-pass air heater requires, all other conditions being equal, a heating surface of 20 to 40 percent smaller than any conventional two-pass cross-flow air heater.

SUMMARY OF THE INVENTION

It is therefore an object of the present invention to provide a Z-cross-flow tubular air heater which will have a minimum heating surface along with reduced weight and dimensions, as compared with a conventional cross-flow air heater.

Another object of the invention is to provide a Z-cross-flow tubular air heater with relatively small dimensions and aerodynamic resistance.

Still another object of the invention is to provide a Z-cross-flow tubular air heater with minimum weight of the air ducts.

These and other objects of the invention are attained in a tubular air heater comprising: a plurality of passes each having tube banks built into a gas conduit through which passes a heating gas; a plurality of air delivery ducts arranged in series one above the other and adjoining the tube banks of each pass and communicating with the tube banks by means of outlets; a plurality of collecting air ducts arranged in series one above the other, adjoining the tube banks of each pass and connected to the tube banks by means of inlets; a plurality of interconnecting air ducts adapted to connect the collecting air duct with a delivery air duct of the next-in-order air pass and arranged in the interspaces between the tube banks of each pass; an inlet orifice provided in each of said plurality of interconnecting air conduits to admit the flow of air passing from the collecting air duct to the interconnecting air conduit; an outlet orifice provided in each of said plurality of interconnecting air conduits for the flow of air to pass therethrough on its way from the interconnecting air conduit to the delivery air duct; an inlet provided in the delivery duct, the first-in-order along the flow of air, for communication with a source of air to be heated; and, an outlet provided in the collecting duct, the last-in-order along the flow of air, for communication with a container for the heated air.

Such air heater construction makes it possible to effect the delivery of air to each pass from one and the same side relative to the gas flow or, in other words, ensure a Z-cross-flow pattern at which the available temperature gradient is used to the maximum or close to that in the counterflow pattern. Accordingly, the heating surface and the dimensions and weight of the described air heater are minimized.

Each tube bank in each pass is preferably made in the form of separate sections provided with a side casing which serves as walls of the interconnecting air conduit. Such structural arrangement makes it possible to minimize the weight of interconnecting air conduits.

BRIEF DESCRIPTION OF THE DRAWINGS

The invention will now be described, by way of example only, with reference to the accompanying drawings, wherein.

DETAILED DESCRIPTION OF THE INVENTION

Figure 1:
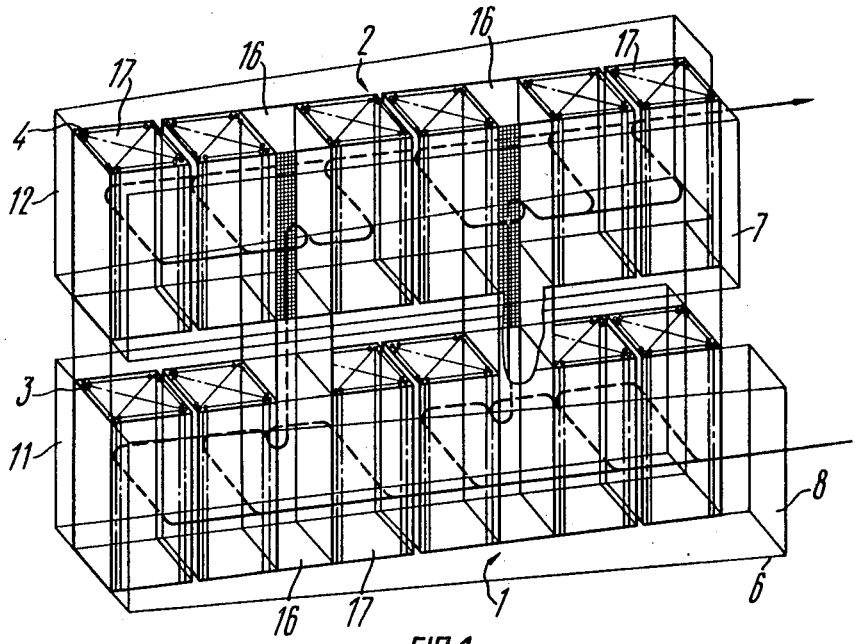
FIG. 1 is an isometric view of a two-pass air heater according to the invention.
Figure 3:
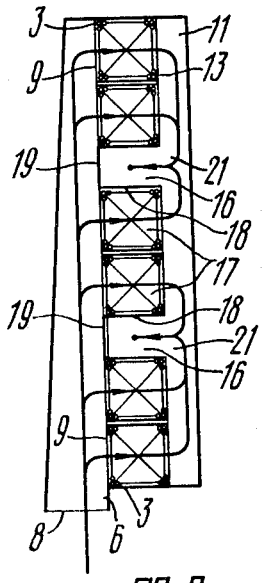
FIG. 3 is a cross-sectional view along the line III—III of FIG. 2.
Figure 4:
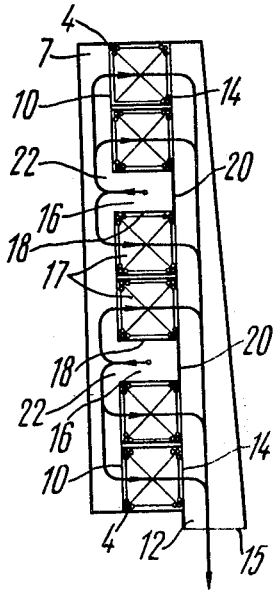
FIG. 4 is a cross-sectional view along on the line IX—IX of FIG. 2.

The air heater, illustrated, comprises two passes 1 and 2 (FIGS. 1 and 2) each of which has tube banks 3 and 4 respectively. The tube banks 3 and 4 are built into a gas conduit 5 (FIG. 2) through which passes a heating gas. In addition, the air heater includes two delivery air ducts 6 and 7 (FIGS. 1 and 2) which are arranged in series one above the other. The delivery air duct 6 adjoins the tube banks 3 of the first pass 1, and the delivery air duct 7 adjoins the tube banks 4 of the second pass 2. The delivery air duct 6 has an inlet 8 (FIG. 3) for communication with a source of air to be heated (not shown) and outlets 9 for communication with the tube banks 3. The delivery air duct 7 has outlets 10 for communication with the tube bank 4. The air heater also incorporates two collecting ducts 11 and 12 (FIGS. 1 and 2) which are placed in series one above the other. The collecting duct 11 adjoins the tube banks 3 of the first pass 1 and the collecting duct 12 adjoins the tube banks 4 of the second pass 2. The collecting duct 11 has inlets 13 (FIG. 3) for communication with the tube banks 3. The collecting duct 12 (FIG. 4) has inlets 14 for communication with the tube banks 4 and an outlet 15 for communication with a container for the heated air. The air heater has two interconnecting air conduits 16 provided to connect the collecting air duct 11 to the delivery air duct 7 and which are arranged in the interspaces between the tube banks 3 and between the tube banks 4. The tube banks 3 and 4 are made in the form of separate sections 17 having a side casing 18. The side casing 18 of the sections 17, adjoining the interconnect air conduits 16, serves as the wall of the latter. Another wall of the interconnecting air conduit 16 is defined by a crosspiece 19 provided in the air delivery duct 6 and a crosspiece 20 provided in the collecting air duct 12. Each of the interconnecting air conduits 16 has an inlet orifice 21 (FIG. 3) intended for communication with the collecting duct 1, and an outlet orifice 22 (FIG. 4) for communication with the delivery duct 7.

Operation of a preferred air heater will now be described.

Figure 2:
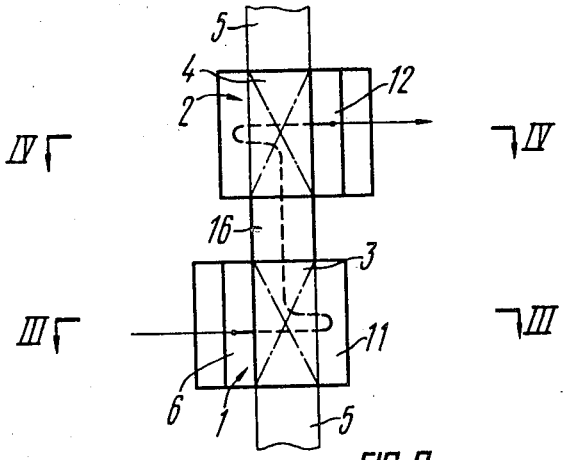
FIG. 2 is a side vertical sectional of an air heater according to the invention.

A flow of air fed from an air heating source is admitted through the inlet 8 (FIG. 3) into the delivery duct 6 wherefrom it passes through the outlets 9 to the tube banks 3 of the first pass 1. A flow of heating gas is concurrently fed from the gas duct 5 to the tubes of the tube banks 3. On being heated in the sections 17 of the tube banks 3, the flow of air passes through the inlets 13 into the collecting duct 11. From the collecting duct 11 the heated air is admitted through the inlet orifice 21 into the interconnecting air conduit 16 along which it is raised to the second pass 2 (FIG. 2) and further on through the outlet orifices 22 (FIG. 4) into the delivery duct 7. Next, the airflow is admitted through the outlets 10 into the tube banks 4 of the second pass to be heated therein to a required temperature by the gases flowing through the tubes. The heated air passes through the inlets 14 into the collecting air duct 12 and from there through the outlet 15 into a container for the heated air. The interconnecting air conduits 16 are provided to ensure the delivery of air to the first and second passes 1 and 2 from one and the same side; the air delivery to the tube banks of the both passes is effected from the left-hand side, as is shown in FIG. 2. Thus, a Z-cross pattern of air flow is created to ensure adequate utilization of the available temperature gradient. For instance, the temperature gradient used in the described two-pass air heater is approximately equal to that usually encountered in a conventional four-pass air heater or, in other words, it is close to the temperature gradient in the counter-flow circuit. As a result, all other conditions being equal, the air heater described requires 20 to 40 percent smaller heating surface than any conventional two-pass air heater. The weight of its surface and its dimensions are equally reduced by the same percentage.

With the interconnecting air conduit 16 being arranged in the interspaces between the tube banks 3 and 4, the length of the air path is shortened and the velocity of the airflow in the ducts 11 and 7 is lowered to result in decreased aerodynamic resistance and dimensions of these ducts. Furthermore, the interconnecting air conduits 16 allow for easy access to the sections 17 of the tube banks 3 and 4. Of vital importance is the provision of the tube banks 3 and 4 in the form of the separate sections 17 with the side casings 18. The side casings 18 permit the sections 17 to be tightly closed together, thereby preventing bypassing of air therealong. This, in turn, makes it possible to attain highly efficient, up to 100 percent, utilization of the heating surface, which reduces the amount of metal required therefor. In view of the fact that the side casings 18 of the sections 17 serve as the walls of the interconnecting air conduit 16, the amount of metal required for the fabrication of the latter is kept to a minimum.

Another distinguishing feature of the described air heater is the arrangement of the tube banks 3 and 4 in the same gas conduit 5. This is especially important where a high-ash low-grade fuel is used. The absence of bends in the passage of gasflow prevents the desintegration of ash therein and thus reduces the rate of abrasive wear of tubes.

Finally, it is to be pointed out that the compact shape of the described air heater is made possible by the delivery ducts 6 and 7 and the collecting ducts 11 and 12 being arranged in series one above the other and adjoining the tube banks 3 and 4.

The air heaters similar to the one described in the present application are now in operation in the USSR. They are incorporated in 500 Mw power units installed in high-ash coal-fired boilers. Where gases are to be cooled from a temperature of 370° to 140° C. and the air to be heated up to 330° C., the air heater of this type, with average velocity of gases being 10 m/sec (ash content in coal about 50%), has a heating surface as small as 130,000 $m^2$ and a weight of only about 2,200 t. It is presumed that there is hardly a lightest air heater of this type known to be anywhere in use for similar purposes.

What is claimed is:

1. A tubular air heater comprising:

gas conduits through which heating gas flows;

a plurality of passes, each of said passes having tube banks built into said gas conduits;

a plurality of delivery air ducts arranged in series one above the other, adjoining said tube banks of each of said plurality of passes and connected to said tube banks by outlets;

a plurality of collecting air ducts arranged in series one above the other, adjoining said tube banks of each of said plurality of passes and connected to said tube banks by inlets;

a plurality of interconnecting air conduits connecting each of said plurality of collecting air ducts with a next-in-order (along the flow of air) delivery air duct, and arranged in interspaces between said tube banks of each pass;

an inlet orifice provided in each of said plurality of interconnecting air ducts to admit the flow of air passing from each of said plurality of collecting air ducts to each of said plurality of interconnecting air conduits;

an outlet orifice provided in each of said plurality of interconnecting air conduits for the flow of air to pass therethrough on the way from each of said plurality of interconnecting air conduits to each of said plurality of delivery air ducts;

an inlet provided in a first-in-order (along the air flow) delivery air duct, for communication with a source of air to be heated; and an outlet provided in a last-in-order (along the flow of air) collecting duct, for communication with a container for the heated air.

2. A tubular air heater as claimed in claim 1, wherein each of said tube banks of each of said plurality of passes is made in the form of separate sections provided with a side casing serving as walls of each of said plurality of interconnecting air conduits.

* * * * *